United States Patent [19]

Wartian

[11] Patent Number: 5,029,913

[45] Date of Patent: Jul. 9, 1991

[54] DOOR LATCH

[76] Inventor: George Wartian, 34938 Island View Dr., E., Mt. Clemens, Mich. 48045

[21] Appl. No.: 562,808

[22] Filed: Aug. 6, 1990

[51] Int. Cl.[5] ..... E05C 1/16

[52] U.S. Cl. ..... 292/169 R

[58] Field of Search ..... 292/169, 169.21, 169.11, 292/169.15, 140, 172, 142

[56] References Cited

U.S. PATENT DOCUMENTS 1,396,441 11/1921 Kulier ..... 292/169.21

1,636,868 7/1927 Schlegel ..... 292/169.11 X

*Primary Examiner*—Richard E. Moore

*Attorney, Agent, or Firm*—Barnes, Kisselle, Raisch, Choate, Whittemore & Hulbert

[57] ABSTRACT

A door latch assembly in which the latch has a relatively long travel between fully extended and fully retracted positions. A latch retractor in the form of a rotor has a camming member which partially retracts the latch in response to initial rotation of the rotor and which fully retracts the latch in response to further rotation of the rotor.

11 Claims, 3 Drawing Sheets

DOOR LATCH

This invention relates generally to door latches and refers more particularly to a door latch assembly for a screen door or a storm door or the like.

SUMMARY OF THE INVENTION

The door latch assembly of this invention includes a latch that has a relatively long travel between fully extended and fully retracted positions. Modern day screen doors and storm doors often are made of materials which have a tendency to shrink. One advantage of this construction is that it makes it possible for the latch to reach the keeper in the adjacent stationary frame even if the door should shrink.

The latch is retracted preferably in two steps, being partially retracted in an initial first step and then fully retracted in a second step. The two steps occur without appreciable interruption in the smooth retraction of the latch.

More specifically and in accordance with the construction about to be described, the latch assembly of this invention comprises a latch slidably mounted in a housing. A latch retractor comprises a rotor mounted in the housing. The rotor has a camming member. The latch has first and second cam-engaging surfaces. The camming member has a first cam engageable with the first cam-engaging surface to partially retract the latch in response to initial rotation of the rotor in one direction. The camming member has a second cam engageable with the second cam-engaging surface to further retract the latch in response to further rotation of the rotor.

It is among the objects of this invention to provide a door latch assembly of relatively simple construction which is rugged, durable, inexpensive to manufacture and highly effective in the accomplishment of its intended function, and which has some or all of the attributes referred to above. Other objects, features and advantages of the invention will become more apparent as the following description proceeds, especially when considered with the accompanying drawings.

DETAILED DESCRIPTION

Figure 1:
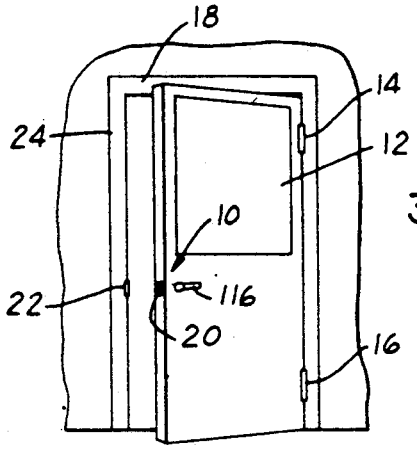
FIG. 1 is a perspective view showing a door equipped with the door latch assembly of this invention.

The latch assembly 10 is shown mounted on the swinging edge of a door 12 which is hinged at 14 and 16 in a frame 18 and having a latch 20 for latching engagement with a keeper 22 in one of the vertical frame members 24.

The latch 20 is an elongated member which is disposed lengthwise within an elongated, tubular, cylindrical housing 28 for longitudinal sliding movement. The housing is formed of two longitudinally extending semicylindrical shells 30 and 32 which are open at both ends and have longitudinally extending edges 34 and 36 along opposite sides which abut one another throughout the full length thereof except for the matching recesses 38 and 40 which cooperate to form openings 42 on opposite sides of the housing.

At the front end of the housing, there is a transverse mounting plate 46. The front end of housing shell 30 is permanently secured plate 46. Shell 32 has a forwardly projecting tab 50 at the front end which extends into a recess 52 in plate 46. A fastener 54 extends across the shells through openings at the rear end thereof to secure the rear ends of the shells together and retain the tab 50 on the front end of shell 32 in the plate recess 52. The latch assembly is disposed within an opening in the door with plate 46 secured to the swinging edge of the door by fasteners 56 and 58.

The front end of the latch is in the form of a cylindrical head 60 which slides within the housing. The forward end of the head has a tapered nose 62 for engagement with the keeper 22 when the door is swung to closed position. The latch has a rearward extension comprising a pair of laterally spaced bars 64. Bars 64 project rearwardly from the latch head parallel to the path of latch movement and terminate in outwardly extending slides 66, 67 which project into the openings 42 to guide the sliding movement of the latch.

Figure 2:
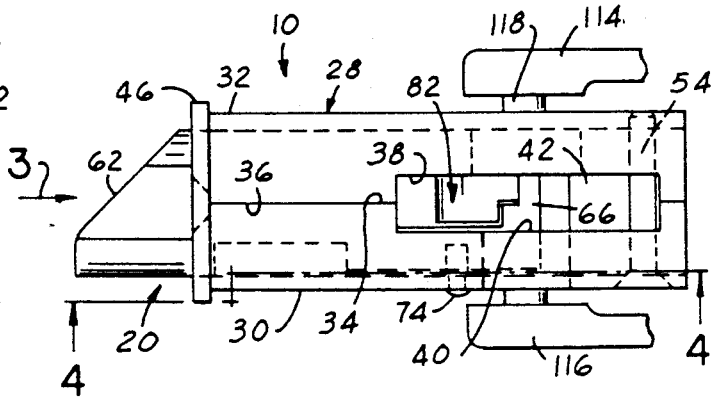
FIG. 2 is a top elevational view of the door latch assembly.
Figure 3:
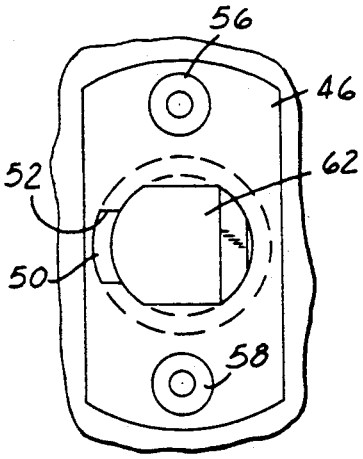
FIG. 3 is a view of the door latch assembly looking in the direction of the arrow 3 in FIG. 2.
Figure 4:
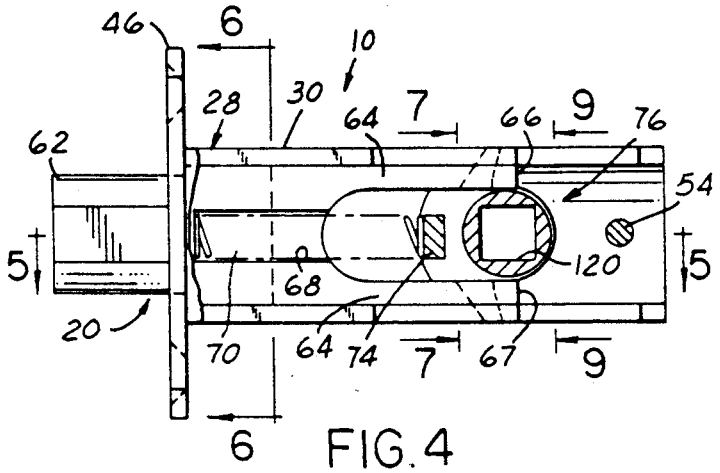
FIG. 4 is a view partially in elevation and partially in section taken on the line 4—4 in FIG. 2.
Figure 5:
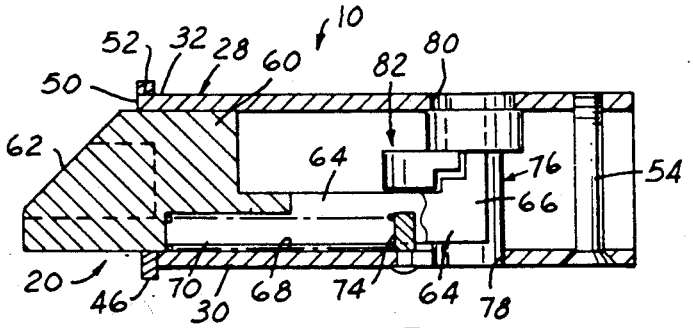
FIG. 5 is a sectional view taken on the line 5—5 in FIG. 4.
Figure 6:
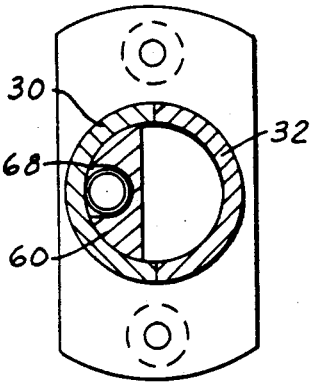
FIG. 6 is a sectional view taken on the line 6—6 in FIG. 4.
Figure 7:
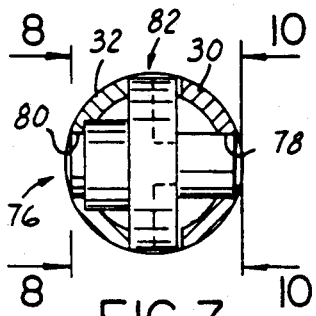
FIG. 7 is a sectional view taken on the line 7—7 in FIG. 4.

A longitudinally extending tunnel or socket 68 extends into the rear end portion of the head. A compression coil spring 70 extends within the tunnel and has one end bearing against the base or bottom of the tunnel. The spring extends rearwardly from the head between the two bars 64 and its opposite end bears against an abutment 74 projecting inwardly from the housing shell 30. The spring 70 is at all times compressed between the bottom of the tunnel and the abutment, urging the latch to the fully extended position shown in FIGS. 2, 4 and 5.

Figure 13:
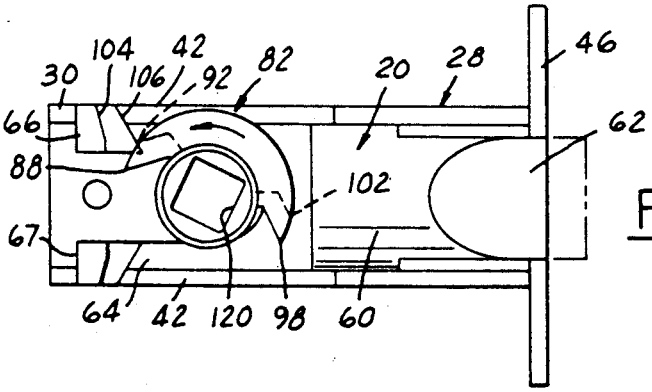
FIG. 13 is like FIGS. 11 and 12, but shows the latch retractor in the position it assumes near the end of the second retraction step.

A latch retractor 76 is provided for retracting the latch from the extended position to the fully retracted position shown in FIG. 13. The latch retractor is in the form of a rotor which extends across the housing near the rear end thereof with circular ends rotatably received in circular openings 78, 80 in the housing shells 30 and 32. The rotor axis is perpendicular to the plane of the bars 64. A camming member 82 is formed on the rotor. The camming member is a generally arcuate formation on the outer surface of the rotor which extends circumferentially from one of its ends to the other approximately one half the distance around the rotor. The opposite ends of the camming member 82 engage the slides 66 and 67 of the latch on the side of the slides adjacent the head end of the latch and thus hold the latch in assembly with the housing.

One end of the camming member 82 is cut to provide a slanted surface 87 which is parallel to but does not pass through the rotor axis and intersects the circular periphery of the camming member in an axially extending edge or cam 88. The same end of the camming member 82 is cut back or recessed at one side thereof to provide a slanted surface 90 which is parallel to but does not pass through the rotor axis and intersects the circular periphery of the camming member in an axially extending edge or cam 92. The surfaces 87 and 90 are circumferentially spaced from one another and the cam edges 88 and 92 are circumferentially spaced from one another.

The other end of the camming member 82 is cut to provide a slanted surface 97 which is parallel to but does not pass through the rotor axis and intersects the circular periphery of the camming member in an axially extending edge or cam 98. The same end of the camming member 82 is cut back or recessed at one side thereof to provide a slanted surface 100 which is parallel but does not pass through the rotor axis and intersects the circular periphery of the camming member in an axially extending edge or cam 102. The surfaces 97 and 100 are circumferentially spaced from one another and the cam edges 98 and 102 are circumferentially spaced from one another.

Figure 8:
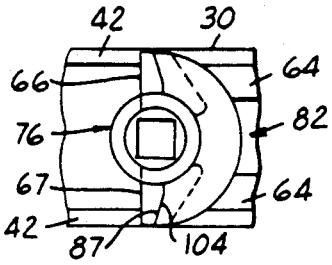
FIG. 8 is a view taken on the line 8—8 in FIG. 7, with part of the housing broken away.
Figure 9:
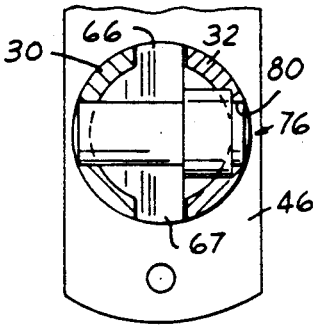
FIG. 9 is a sectional view taken on the line 9—9 in FIG. 4.

The slide 66 has a cam-engaging surface 104 which is opposed to and confronts the surface 87 on camming member 82 and is disposed at approximately the same angle as the surface 87 when the rotor is in the neutral position of FIG. 8. The slide 66 has a second cam-engaging surface 106 which is opposed to and confronts the surface 90 on camming member 82 and is disposed at approximately the same angle as the surface 90 when the rotor is in the neutral position of FIG. 8. The cam-engaging surfacaes 104 and 106 are spaced from one another in the direction of sliding movement of the latch.

The slide 67 has a cam-engaging surface 110 which is opposed to and confronts the surface 97 on camming member 82 and is disposed at approximately the same angle as the surface 97 when the rotor is in the neutral position of FIG. 8. The slide 67 has a second cam-engaging surface 112 which is opposed to and confronts surface 100 of the camming member 82 and is disposed at approximately the same angle as the surface 100 when the rotor is in the neutral position of FIG. 8. The cam-engaging surfaces 110 and 112 are spaced from one another in the direction of sliding movement of the latch.

Figure 16:
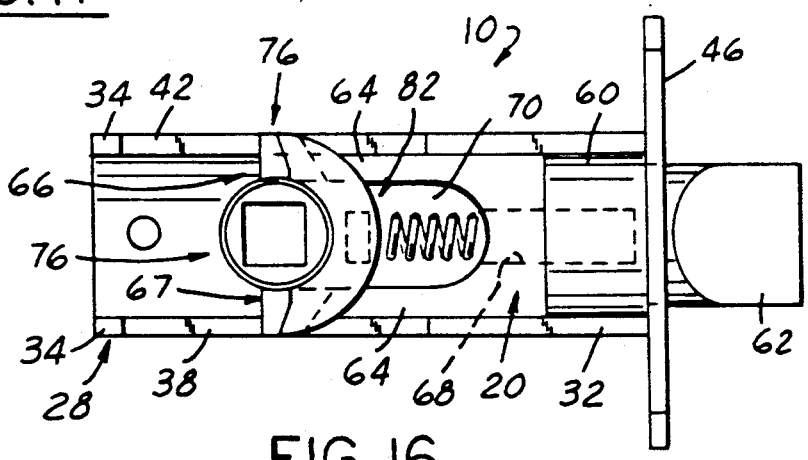
FIG. 16 is similar to FIG. 11, but shows the latch fully extended and the latch retractor in neutral position.

With the rotor in the neutral position of FIGS. 8 and 16, the latch is fully extended so that the nose of the latch head is in a position to engage the keeper 22 and latch the door in closed position. The rotor 76 may be turned in either direction from its neutral position by means of one or the other of the handles 114 and 116 on opposite sides of the door which are connected to the ends of a square shaft 118 non-rotatably received in and extending through the square opening 120 in the rotor.

Figure 11:
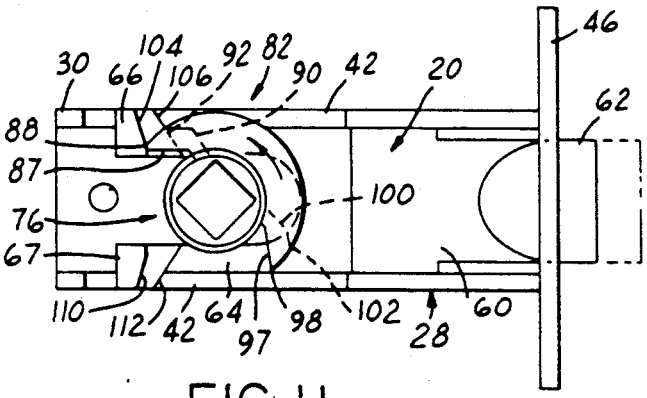
FIG. 11 is an elevational view of the latch assembly with part of the housing broken away and showing the latch retractor in the position that it assumes after the latch has been initially partially retracted in a first step.
Figure 10:
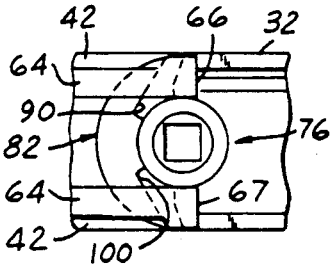
FIG. 10 is a view taken on the line 10—10 in FIG. 7, with part of the housing broken away.
Figure 12:
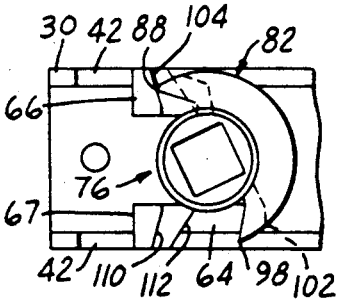
FIG. 12 is a view like FIG. 11, but showing the latch retractor and latch prior to completion of the first step.

In use, and assuming it is desired to retract the latch by counter clockwise rotation of the rotor 76, the edge or cam 88 on camming member 82 will first engage the cam-engaging surface 104 of slide 66 and begin to move the latch away from fully extended position (See FIG. 12). Continued counter-clockwise rotation of the rotor further retracts the latch by the action of cam 88 on cam-engaging surface 104. FIG. 11 shows the latch retracted about half way towards its fully retracted position at the end of an initial stage or step carried out by cam 88.

Cam 92 takes over upon continued counter-clockwise rotation of the rotor 76 by engagement with cam-engaging surface 106 and moves the latch to the fully retracted position seen in FIG. 13. The further retraction of the rotor by cam 92 carries out the second stage or step in the retraction, although it should be understood that both the first and second stages or steps in the retraction accomplished in sequence by cams 88 and 92 is smooth and uninterrupted. FIG. 11 illustrates how at the completion of the first step in the retraction of the latch by cam 88, cam 92 takes over to initiate the second step in the retraction.

Figure 14:
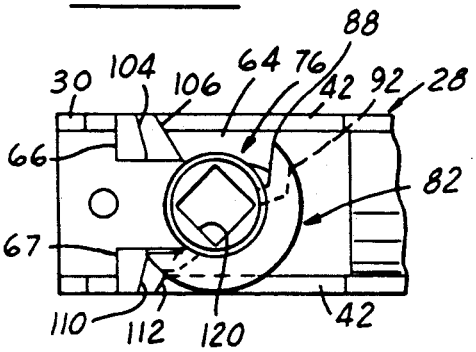
FIGS. 14 and 15 are similar to FIGS. 11 and 13, but show the latch retractor turned in the opposite direction which also results in retraction of the latch.
Figure 15:
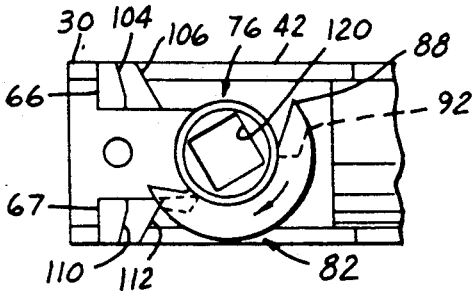
Figure 18:
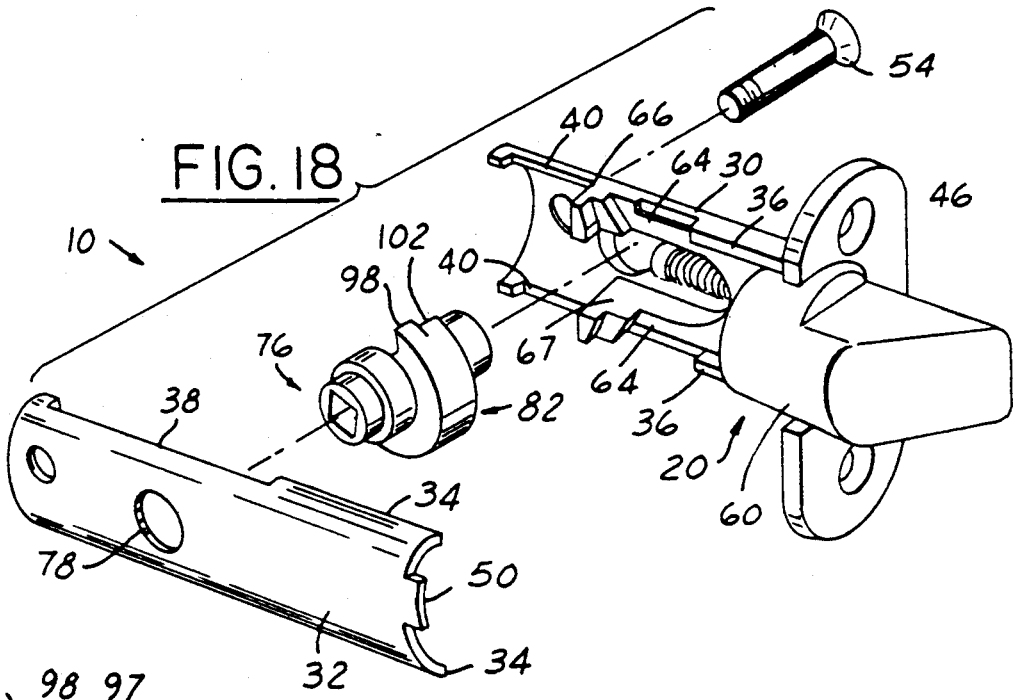
FIG. 18 is an exploded perspective view of the door latch assembly.
Figure 17:
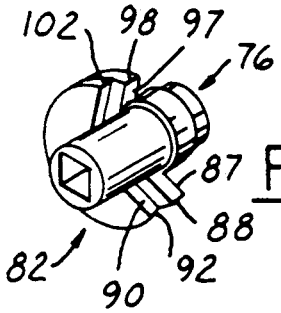
FIG. 17 is a perspective view of the latch retractor.

FIGS. 14 and 15 show how the latch is retracted by clockwise movement of the rotor through the action of cam 98 upon cam-engaging surface 110 of slide 67 in a first step and subsequent action of cam 102 upon cam-engaging surface 112 to accomplish a full retraction of the latch. Thus the latch is retracted in an identical two step sequence upon rotation of rotor 76 in either a clockwise or a counter-clockwise direction.

What is claimed is:

1. A door latch assembly comprising a housing, a latch slidably mounted in said housing for movement between an extended, latching position and a retracted position, and a latch retractor comprising a rotor mounted in said housing for rotation, said rotor having a camming member, said latch bolt having first and second cam-engaging surfaces, said camming member having a first cam engageable with said first cam-engaging surface to partially retract said latch from its latching position in response to initial rotation of said rotor in one direction, said camming member having a second cam engageable with said second cam-engaging surface to further retract said latch in response to further rotation of said rotor in said one direction, said latch having third and fourth cam-engaging surfaces, said camming member having a third cam engageable with said third cam-engaging surface to partially retract said latch from its latching position in response to initial rotation of said rotor in the opposite direction, said camming member having a fourth cam engageable with said fourth cam-engaging surface to further retract said latch in response to further rotation of said rotor in said opposite direction.

2. The door latch assembly defined in claim 1, including spring means urging said latch to its extended, latching position.

3. The door latch assembly defined in claim 1, wherein said camming member is a generally arcuate formation on the outer surface of said rotor, said camming member extending circumferentially from one of its ends to the other for a substantial distance around said rotor, said first and second cams occupying positions at said one end of said camming member, said third and fourth cams occupying positions at said other end of said camming member.

4. The door latch assembly defined in claim 3, wherein said camming member extends circumferentially approximately one-half the distance around said rotor, and said cams are in the form of generally axially extending edges adjacent the radially outer surface of said camming member.

5. A door latch assembly comprising an elongated tubular housing, an elongated latch disposed lengthwise within said housing for longitudinal sliding movement between an extended, latching position and a retracted position, said latch having a nose at the front end projecting beyond said housing in said extended, latching position thereof, spring means urging said latch to its extended, latching position, and a latch retractor comprising a rotor extending across and mounted in said housing for rotation, said rotor having a camming member, said latch having a rearward extension comprising a pair of laterally spaced rearwardly extending bars, one said bar having first and second cam-engaging surfaces, the other said bar having third and fourth cam-engaging surfaces, said camming member comprising a generally arcuate formation on the outer surface of said rotor, said camming member extending circumferentially from one of its ends to the other approximately one-half the distance around said rotor, said camming member having first and second cams occupying circumferentially spaced positions at one end of said camming member and having third and fourth cams occupying circumferentially spaced positions at the opposite end of said camming member, said first cam being engageable with said first cam-engaging surface to partially retract said latch from its latching position in response to initial rotation of said rotor in one direction, said second cam being engageable with said second cam-engaging surface to further retract said latch in response to further rotation of said rotor in said one direction, said third cam being engageable with said third cam-engaging surface to partially retract said latch in response to initial rotation of said rotor in the opposite direction, said fourth cam being engageable with said fourth cam-engaging surface to further retract said latch in response to further rotation of said rotor in said opposite direction.

6. The latch bolt assembly defined in claim 5, wherein each of said bars has a slide on the rear end thereof, said housing having means slidably engaging said slides to guide the longitudinal movement of said latch, said first and second cam-engaging surfaces being formed on one of said slides, said third and fourth cam-engaging surfaces being formed on the other of said slides.

7. The latch bolt assembly defined in claim 6, wherein said first, second, third and fourth cams are in the form of axially extending edges adjacent the radially outer surface of said camming member.

8. The latch bolt assembly defined in claim 6, wherein said first and second cam-engaging surfaces are spaced apart in the direction of movement of said latch and said third and fourth cam-engaging surfaces are spaced apart in the direction of movement of said latch.

9. A door latch assembly comprising an elongated tubular housing, an elongated latch disposed lengthwise within said housing for longitudinal sliding movement between an extended, latching position and a retracted position, said latch having a nose at the front end projecting beyond said housing in said extended, latching position thereof, spring means urging said latch to its extended, latching position, and a latch retractor comprising a rotor mounted in said housing for rotation, said rotor extending across the path of sliding movement of said latch with its axis of rotation perpendicular to said path, said rotor having a camming member, said latch having a rearward extension provided with first and second cam-engaging surfaces spaced apart along the path of sliding movement of said latch and also in the direction of the rotor axis, said camming member having radially outwardly extending first and second cams disposed in circumferentially spaced relation to one another, and spaced apart in the direction of the rotor axis, said first cam being engageable with said first cam-engaging surface to partially retract said latch from its latching position in response to initial rotation of said rotor in one direction, said second cam being engageable with said second cam-engaging surface to further retract said latch in response to further rotation of said rotor in said one direction.

10. The latch bolt assembly defined in claim 9, including means for guiding the longitudinal movement of said latch and preventing rotation thereof relative to said housing comprising a slide on said extension of said latch, and means defining an elongated opening in a wall of said housing in which said slide is slidably engaged.

11. The latch bolt assembly defined in claim 10, wherein said first and second cam-engaging surfaces are formed on said slide.

* * * * *